US010683719B2

(12) United States Patent
Motland

(10) Patent No.: US 10,683,719 B2
(45) Date of Patent: Jun. 16, 2020

(54) WIRELINE TRACTOR COMPRISING A DISC-SHAPED CUTTING DEVICE FOR PERFORATING OF A TUBING WALL AND METHOD FOR PERFORATING A TUBING WALL

(71) Applicant: Qinterra Technologies AS, Stavanger (NO)

(72) Inventor: Arne Motland, Stavanger (NO)

(73) Assignee: Qinterra Technologies AS, Stavanger (NO)

( * ) Notice: Subject to any disclaimer, the term of this patent is extended or adjusted under 35 U.S.C. 154(b) by 51 days.

(21) Appl. No.: 15/108,622

(22) PCT Filed: Jan. 8, 2015

(86) PCT No.: PCT/NO2015/050003
§ 371 (c)(1),
(2) Date: Jun. 28, 2016

(87) PCT Pub. No.: WO2015/112022
PCT Pub. Date: Jul. 30, 2015

(65) Prior Publication Data

US 2016/0319618 A1 Nov. 3, 2016
US 2017/0191327 A9 Jul. 6, 2017

(30) Foreign Application Priority Data

Jan. 24, 2014 (NO) ..... 20140083

(51) Int. Cl.
*E21B 29/00* (2006.01)
*E21B 43/11* (2006.01)
*E21B 23/00* (2006.01)

(52) U.S. Cl.
CPC ..... *E21B 29/005* (2013.01); *E21B 23/00* (2013.01); *E21B 29/00* (2013.01); *E21B 43/11* (2013.01); *E21B 2023/008* (2013.01)

(58) Field of Classification Search
CPC ..... E21B 29/00; E21B 29/005
See application file for complete search history.

(56) References Cited

U.S. PATENT DOCUMENTS 1,339,641 A 5/1920 Wright
1,643,572 A 9/1927 Black
(Continued)

FOREIGN PATENT DOCUMENTS

GB 2434819 A 8/2007
WO 2006115418 A1 11/2006
WO 2010123375 A1 10/2010

*Primary Examiner* — Robert E Fuller
*Assistant Examiner* — Lamia Quaim
(74) *Attorney, Agent, or Firm* — Gable Gotwals

(57) ABSTRACT

This invention relates to a wireline tractor (10) for use in a casing or tubing (4) in a well. The wireline tractor (10) includes at least one retractable wheel (14) for driving within the casing or tubing (4) and a rotatable disc-shaped cutting device (11) mounted on an actuator (13) that is coupled to the wireline tractor. The cutting device (11) and the actuator (13) are configured for pressing the cutting device (11) against a wall of the casing or tubing (4) and for cutting a perforation (100) in the wall of the casing or tubing (4), in operational use of the wireline tractor (10). The invention further relates to a method for perforating a casing or tubing (4) in a well.

16 Claims, 4 Drawing Sheets

(56) References Cited

U.S. PATENT DOCUMENTS

| | | | | |
|---|---|---|---|---|
| 2,859,943 | A * | 11/1958 | Chadderdon | E21B 29/005 166/55.8 |
| 4,389,765 | A | 6/1983 | Thompson | |
| 2004/0154809 | A1 | 8/2004 | Bakke | |
| 2008/0135226 | A1 | 6/2008 | Levis et al. | |
| 2009/0071640 | A1 | 3/2009 | Ivanov et al. | |
| 2011/0192589 | A1 | 8/2011 | Fuhst et al. | |
| 2013/0319651 | A1* | 12/2013 | Pasvandi | E21B 43/112 166/55.2 |
| 2014/0013731 | A1 | 1/2014 | Hallundbaek | |
| 2014/0014323 | A1 | 1/2014 | Hallundbaek | |
| 2014/0124191 | A1* | 5/2014 | Hallundbæk | E21B 29/00 166/55.2 |

* cited by examiner

WIRELINE TRACTOR COMPRISING A DISC-SHAPED CUTTING DEVICE FOR PERFORATING OF A TUBING WALL AND METHOD FOR PERFORATING A TUBING WALL

CROSS-REFERENCE TO RELATED APPLICATIONS

This United States application is the National Phase of PCT Application No. PCT/NO2015/050003 filed 8 Jan. 2015, which claims priority to Norwegian Patent Application No. 20140083 filed 24 Jan. 2014, each of which is incorporated herein by reference.

BACKGROUND OF THE INVENTION

The invention relates to a wireline tractor for use in a casing or tubing in a well. The invention further relates to a method for perforating a casing or tubing in a well.

In the petroleum industry various kinds of downhole tools are used for operations in a well. One of the operations to be carried out downhole is to make perforations in the tubing or casing. Existing solutions are the use of explosives or chemicals, which have the drawback of being hazardous. Another existing solution is a special cutter tool for wireline applications. Despite the existence of this cutter tool there is still a need to improve upon the speed of such tools.

The invention has for its object to remedy or to reduce at least one of the drawbacks of the prior art, or at least provide a useful alternative to prior art.

The object is achieved through features, which are specified in the description below and in the claims that follow.

In a first aspect the invention relates more particularly to a wireline tractor for use in a casing or tubing in a well, wherein the wireline tractor comprises at least one retractable wheel for driving within the casing or tubing and a rotatable disc-shaped cutting device mounted on an actuator that is coupled to the wireline tractor, the cutting device and the actuator being configured for pressing said cutting device against a wall of the casing or tubing and for cutting an perforation in said wall of the casing or tubing, in operational use of the wireline tractor. The perforation has in most embodiments an elongate shape. Preferably, the cutting device is so arrange that the elongate shape extends parallel to the tubing or casing (axial orientation). However, this is not essential, as the actuator may be tilted such that the elongate perforation extends in a different direction. The invention is conveniently embodiment into a wireline tractor, because of its auto-centration properties in operational use in a tubing or casing.

The effect of the wireline tractor of the invention is that the cuts can be made very quickly (by spinning the rotating element to very high speeds) and very accurately in terms of position (because of the inherent positioning properties of wireline tools in general). Such effects even become more profound in case the invention is embodied in a wireline tractor.

In an embodiment of the wireline tractor the actuator comprises a lever arm that is pivotably mounted to the wireline tractor on one end thereof and mechanically coupled to the rotatable disc-shaped cutting device on an opposite end thereof, wherein outward movement of the cutting device is controlled by controlling the pivot angle of the lever arm. The use of a lever arm to control the extension of the rotatable disc-shaped cutting device. Moreover, such technology is already used in wireline tractors for the wheel suspension.

In an embodiment of the wireline tractor the lever arm is mounted such that a movement of the wireline tractor in the direction of the surface will force an inward movement of the lever arm forcing the lever arm back in the direction of its original position. An anchor point of the lever arm is preferably located at the surface facing end of the wireline tractor. A clear advantage of this embodiment is that it renders the wireline tractor more fail safe, i.e. the wireline tractor will not so easily get stuck with its cutting device in the perforation.

In an embodiment of the wireline tractor a maximum outward movement of the cutting device is restricted to a predefined settable distance. In this way it is possible to control the length of the perforation. The maximum outward movement may be limited by limiting the actuator mechanically, but also by giving the cutting device a specific configuration (for instance a specific shape) such that is cannot cut much deeper than the thickness of the actual wall. Another purpose of limiting the outward movement is to protect any objects behind the wall that is cut from being cut also by the cutting device. For instance, in case a tubing is being perforated, there is a need for preventing the casing to be cut also.

It is inherent to the disc-shaped cutting device that the maximum length of the perforation that is cut in a single run is equal to about the diameter of the disc-shaped cutting device, in case the wireline tractor is not moved. This is not exactly true in case of a pivoting actuator. In any case, in such embodiment the length of the perforation can be controlled by controlling the depth over which the cutting device into the wall of the casing or tubing.

In another embodiment perforations are made which are longer than the diameter of the disc-shaped cutting device. Such effect can be achieved by repeating the cutting operation after moving the wireline tractor over a certain displacement length (smaller than the diameter of the disc-shaped cutting device). Alternatively, the displacing could also be carried out simultaneously during the cutting operation. In the latter scenario very long cuts can be made in a single run. Particularly in this embodiment it is very advantageous to limit the maximum outward movement of the cutting device.

In an embodiment of the wireline tractor the cutting device and/or the actuator are at least one of electrically driven, electromagnetically driven, hydraulically-mechanically driven, and mechanically driven. These options are the most suitable for driving the actuator and cutting device.

In an embodiment of the wireline tractor a width of the cutting device is smaller than a minimum width of the at least one retractable wheel of the wireline tractor. The advantage of this embodiment is that the normal wheels of the wireline tractor will not easily get stuck into the tubing or casing when the wireline tractor is being moved up or down the tubing or casing.

In an embodiment of the wireline tractor the tool is provided with a plurality of further rotatable disc-shaped cutting devices being configured for pressing said cutting device against the casing or tubing and for cutting further perforations in said casing or tubing, in operational use of the wireline tractor. The more cutting devices are provided on the wireline tractor, the faster the operation may be carried out.

In a second aspect the invention relates more particularly to a method for perforating a casing or tubing in a well, the method comprising the steps of:

providing a wireline tractor in accordance with the invention;

providing the wireline tractor in the casing or tubing;

pressing the cutting device against a wall of the casing or tubing, and cutting an perforation in said wall of the casing or tubing.

The advantages and effects of the method follow those of the device in accordance with the invention.

In the following is described an example of a preferred embodiment illustrated in the accompanying drawings, wherein.

Figure 1:
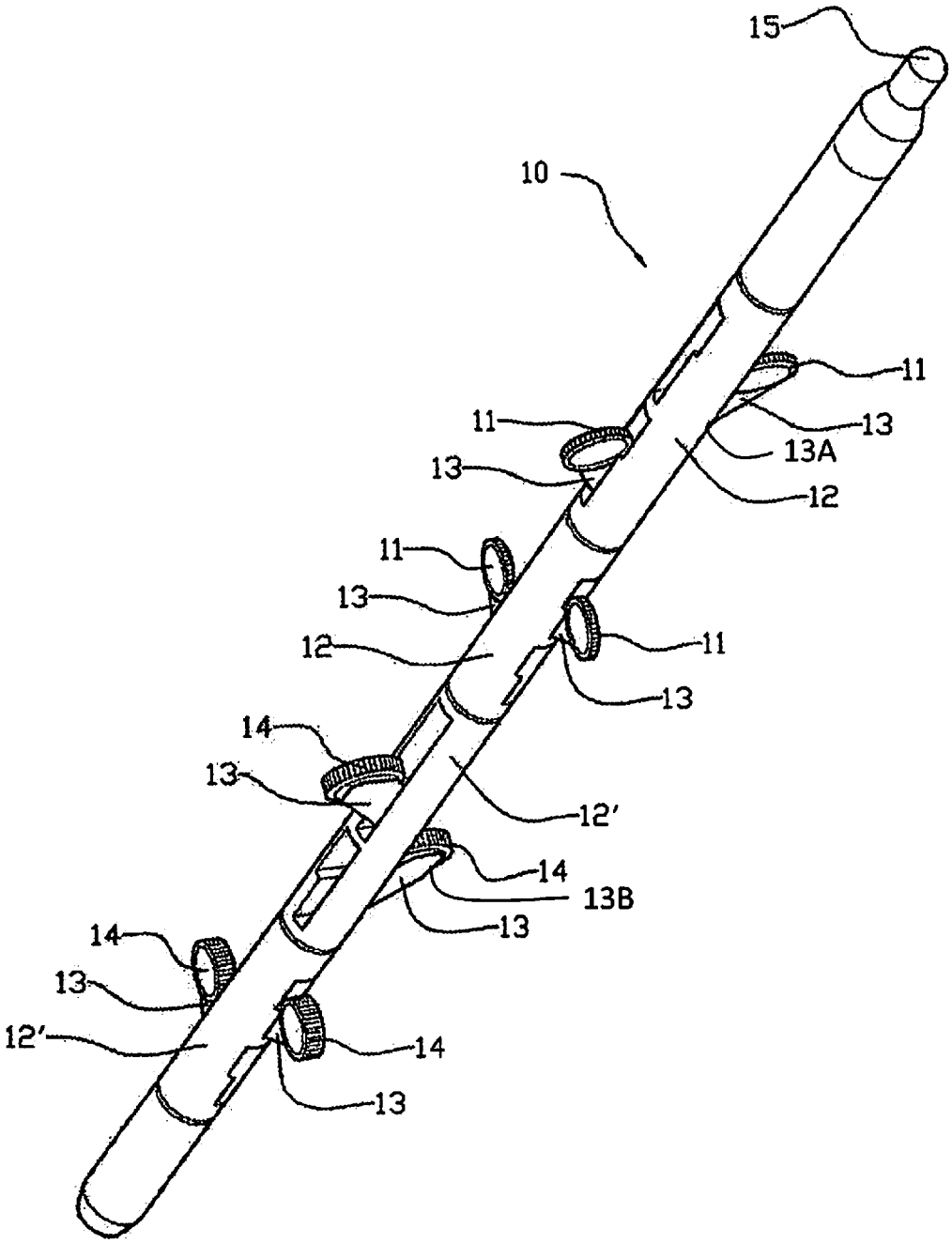
FIG. 1 shows a wireline tractor in accordance with an embodiment of the invention.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage. Throughout the Figures, similar or corresponding features are indicated by same reference numerals or labels.

FIG. 1 shows a wireline tractor 10 in accordance with an embodiment of the invention. The tractor 10 comprises one or more cutting sections 12, wherein each cutting section comprises one or more cutting devices 11. In this embodiment each cutting device 12 is mounted on a separate actuator 13 (a lever arm in this embodiment), but this is not essential to the invention. The tractor 10 further comprises one or more driving sections 12, wherein each driving section 12 comprises one or more wheels 14 mounted to a separate actuator 13 (again, a lever arm in this embodiment). The actuator 13 may be coupled at a first end 13A to the section 12 and configured at a second end 13B to press toward a wall of the casing or tubing and receive, interchangeably, a retractable wheel 14 and a cutting device 11. In this way, wireline tractor wheel technology may be used for the purpose of cutting a slit in the wall of the tubing or casing. Because the cutting devices 11 may be connected to the same actuators 13 as the wheels 14, the cutting system makes use of the wheel system, the only difference being that some of the wheels 14 are replaced by a cutting device 11. Furthermore, there is shown a front end 15 of the tractor 10. Such front end 15 may be configured for being connected to a further downhole tool as will be appreciated by the person skilled in the art. In this particular example the front two sections 12 are configured as cutting sections, but this is not essential to the invention.

Figure 2:
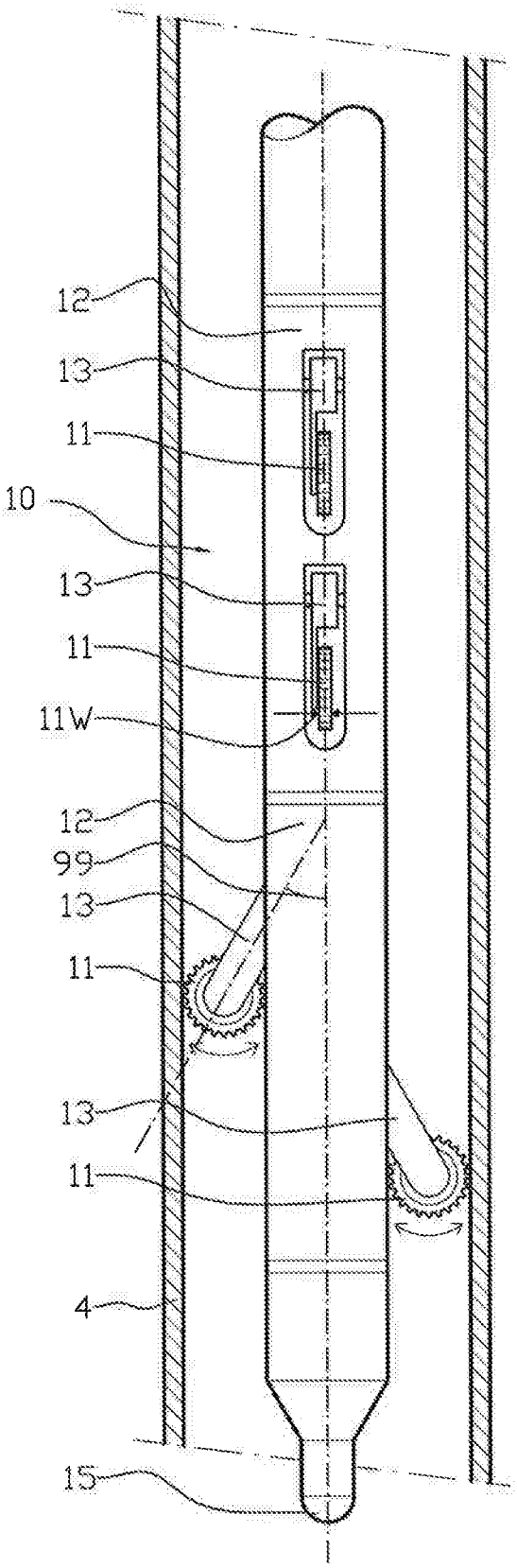
FIG. 2 shows part of the wireline tractor when used in a tubing or casing.

FIG. 2 shows part of the wireline tractor 10 when used in a tubing or casing 4. This figure further illustrates some aspects of the invention. A first aspect is that each of the two illustrated cutting sections 12 has been provided with two cutting devices 11, one on each side. One important aspect is that there is an angular displacement in the orientation of said pairs of cutting devices 11. In this example that is 90 degrees (but other angles are also possible). In other words, one pair of the cutting devices 11 lies in one vertical plane V1 passing through the longitudinal axis 10L of the tractor 10 and intersecting a horizontal plane H defining a clock direction (e.g. from 12 o'clock to 6 o'clock) and another pair of the cutting devices 11 lying in another vertical plane V2 passing through the longitudinal axis 10L and intersecting the horizontal plane H at a different clock position (e.g. 3 o'clock to 9 o'clock), the two planes V1 and V2 intersecting one another. A second aspect is that the widths 11W of the cutting blade of the cutting device 11 have been chosen to be smaller than a width of the wheels 14 of the tractor. In this way the wheels of the tractor will not easily get stuck in the perforation that have been cut. However, this is not essential to the invention. A third aspect is that the level of outward extension of the cutting devices 11 is controlled by controlling the angle 99 between the lever arm 13 and the axial direction of the tool. It is important to note that in this embodiment a rotation is converted into a translation of the cutting device having an component both in the transversal direction (outward direction) as well in the axial direction (in this embodiment in the direction of the surface). Either such axial displacement could be taken into account (it will influence the shape of the perforation) or it may be compensated for by movement of the tractor.

Figure 3:
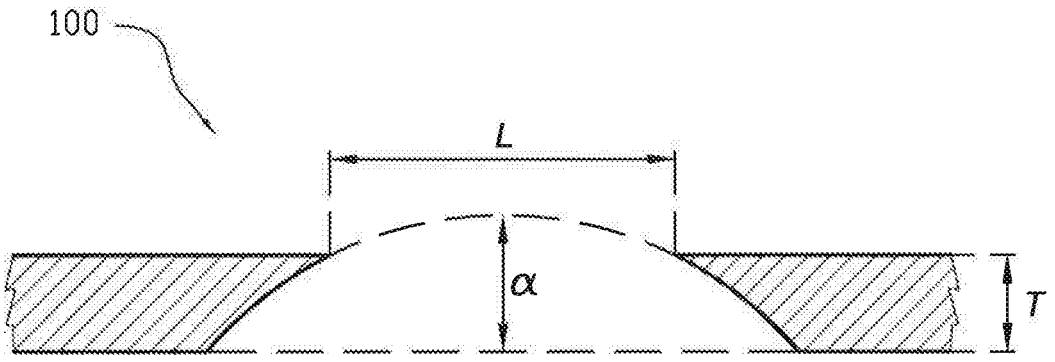
FIG. 3 illustrates some of the principles of using a cutting blade as perforation tool.
Figure 4:
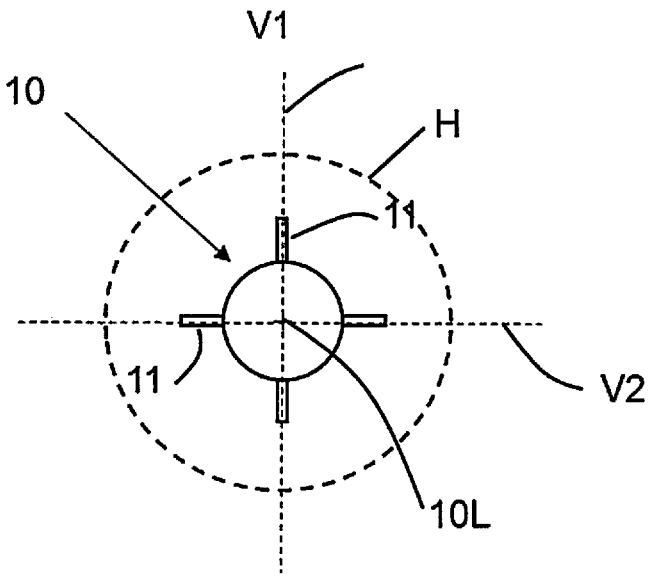
FIG. 4 is a schematic top plan view of an embodiment of the wireline tractor, illustrating an offset of pairs of cutting devices relative to one another.

FIG. 3 illustrates some of the principles of using a cutting blade as perforation tool. The figure serves to illustrate that the length L of the perforation 100 can be controlled by controlling the cutting depth a over of the cutting device. There is a perforation as long as this cutting depth is more than the thickness T of the wall of the casing or tubing. The maximum outward movement of the cutting device can be restricted such that a length of the perforation 100 can be controlled.

Both the size (determined on the length) of the perforations as well as the total number of perforations are important, and are often specified by the customer. The required size and number are generally determined by the flow rate that is required, but the required size is also determined by the fact that the perforations must be able to handle some debris without clogging up.

It is also possible to provide the tractor with a so-called anchoring device (not shown) that fixes the position of the tractor during the cutting operation.

Furthermore, a magnet or other catching device may be added at the downstream side of the tractor in order to collect the cutting debris.

Furthermore, performance sensors for monitoring performance and results may be added. This opens up the possibility to do, for instance, volume tests. If such tests indicate rates (through the perforations) that are too low, more perforations can be made in the same run in the well.

The invention relates to a tool for downhole operations whose purpose is to make perforations in the casing or production tubing using a rotary cutting tool. Cuts can be performed in some degree offset in diameter and some millimetres displacement in the longitudinal direction. One or more electrically, electromagnetically, hydraulically-mechanically or mechanically-driven cutting units, which swing out in one or more directions, from one or more of the sections arranged in the longitudinal direction and the angular offset between themselves for the purpose of performing a slot cutting operation whose purpose is to perforate the tubing towards the surrounding area. The mechanism for manipulating the lever arms could be electrical, electromechanical, hydraulic-mechanical and constructed in such a way that the movement is controlled directly or indirectly to restrict deflection of cutting movement, which in turn affects the opening obtained by cutting property.

The invention claimed is:

1. Wireline tractor for use in a casing or tubing in a well, said wireline tractor having a front end configured for being connectable to a further downhole tool, the wireline tractor comprises:

an elongated body extending along a longitudinal axis;

a plurality of actuators coupled at a first end to the elongated body and configured at a second end to press toward a wall of the casing or tubing and receive, a retractable wheel or a rotatable disc-shaped cutting device having a blade;

at least one pair of retractable wheels, each retractable wheel of the at least one pair being mounted to the elongated body by connection to a respective second end of a respective actuator of the plurality of actuators to enable displacement along the longitudinal axis;

at least two pairs of rotatable disc-shaped cutting devices having a blade oriented for rotation in a longitudinal direction of the wireline tractor to create at least one perforation in the casing or tubing that extends in the longitudinal direction, each rotatable disc-shaped cutting device of the at least two pairs being thinner in width than each retractable wheel of the at least one pair and mounted to the elongated body by connection to a respective second end of a respective actuator of the plurality of actuators; and one pair of the at least two pairs of the at least two pair of rotatable disc-shaped cutting devices being in a first vertical plane containing the longitudinal axis when mounted to the elongated body and another pair of the at least two pairs of rotatable disc-shaped cutting devices being in a second different vertical plane containing the longitudinal axis when mounted to the elongated body.

2. The wireline tractor as claimed in claim 1, wherein the actuators of the plurality of actuators include a lever arm that is pivotably mounted at the first end to the elongated body and mechanically coupled at the second end to the rotatable disc-shaped cutting devices, wherein outward movement the rotatable disc-shaped cutting devices is controlled by controlling a pivot angle of the lever arm.

3. The wireline tractor as claimed in claim 2, wherein the lever arm is mounted such that a movement of the wireline tractor in a direction of a surface will force an inward movement of the lever arm forcing the lever arm back in a direction of its original position.

4. The wireline tractor as claimed in claim 1, wherein a maximum outward movement of at least one pair of rotatable disc-shaped cutting device is restricted to a predefined settable distance to control the length and depth of the perforations.

5. The wireline tractor as claimed in claim 1, wherein the at least one pair of rotatable disc-shaped cutting devices and/or at least one actuator of the plurality of actuators are driven by at least one means selected from the group consisting of electrically driven, electromagnetically driven, hydraulically-mechanically driven, and mechanically driven.

6. The wireline tractor as claimed in claim 1, wherein a width of one in the two pair of rotatable disc-shaped cutting devices is smaller than a minimum width of the at least one pair of retractable wheels and smaller than the perforations that extend parallel with the longitudinal axis.

7. Method for perforating a casing or tubing in a well, the method comprising:

providing a wireline tractor having a front end configured for connecting to a further downhole tool into the casing or tubing, the wireline tractor having an elongated body extending along a longitudinal axis and having at least one pair of retractable wheels for driving within a casing or tubing and at least two pairs of rotatable disc-shaped cutting devices including a blade, each retractable wheel and each rotatable disc-shaped cutting device mounted on a respective actuator of a plurality of actuators coupled at a first end to the elongated body, a second end of each actuator configured to receive a retractable wheel or a rotatable disc-shaped cutting device, the plurality of actuators being configured for pressing said at least two pairs of rotatable disc-shaped cutting devices against a wall of the casing or tubing and for cutting a perforation in the wall of the casing or tubing in a longitudinal direction, one pair of the at least two pairs of rotatable disc-shaped cutting devices being in a first vertical plane containing the longitudinal axis when mounted to the elongated body and another pair of the at least two pairs of disc-shaped cutting device being in a second different vertical plane containing the longitudinal axis when mounted to the elongated body;

pressing the at least two pair of disc-shaped cutting devices against the wall of the casing or tubing, and cutting at least one perforation that extends in the longitudinal direction in said wall of the casing or tubing that is smaller than a width of the at least one pair of retractable wheels.

8. The wireline tractor as claimed in claim 1, wherein an angular displacement of the first vertical plane is up to 90° from the second vertical plane.

9. The wireline tractor as claimed in claim 8, wherein the angular displacement is 90°.

10. Wireline tractor for use in a casing or tubing in a well, the wireline tractor having a front end configured to connect to a further downhole tool, said wireline tractor comprises:

an elongated body extending along a longitudinal axis;

a plurality of actuators each pivotally mounted at a first end to the elongated body and configured at a second end to press outward from the elongated body and to receive a retractable wheel or at least one perforation tool;

at least one retractable wheel mounted to the second end of one actuator of the plurality of actuators; and the at least one perforation tool mounted to the second end of another actuator of the plurality, the perforation tool configured to perforate the casing or tubing in a longitudinal direction.

11. The wireline tractor of claim 10, the perforation tool comprising:

at least one disc-shaped cutting blade configured for rotation in the longitudinal direction.

12. The wireline tractor of claim 10, a second perforation tool mounted to the second end of an actuator of the plurality and configured to perforate the casing or tubing in the longitudinal direction.

13. The wireline tractor of claim 12, the actuator of the second perforation tool being mounted to the elongated body in second vertical plane containing the longitudinal axis that is different than a first vertical plane containing the another actuator of the at least one perforation tool.

14. The wireline tractor of claim 12, the second perforation tool comprising:

at least one disc-shaped cutting blade configured for rotation in the longitudinal direction.

15. The wireline tractor of claim 12, the second perforation tool being narrower in width than the at least one retractable wheel.

16. The wireline tractor of claim 10, the perforation tool being narrower in width than the at least one retractable wheel.

* * * * *